US010217581B2

(12) United States Patent
Famy et al.

(10) Patent No.: US 10,217,581 B2
(45) Date of Patent: Feb. 26, 2019

(54) ACTUATION SYSTEM OF A VACUUM BOTTLE

(71) Applicant: Schneider Electric Industries SAS, Rueil-Malmaison (FR)

(72) Inventors: Francois Famy, Claix (FR); Patrice Grosjean, Varennes Saint Sauveur (FR); Pierre Newinger, Montbonnot Saint Martin (FR); Daniel Reviron, Echirolles (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 15/710,312

(22) Filed: Sep. 20, 2017

(65) Prior Publication Data

US 2018/0090288 A1 Mar. 29, 2018

(30) Foreign Application Priority Data

Sep. 23, 2016 (FR) ..... 16 58958

(51) Int. Cl.
*H01H 33/666* (2006.01)
*H01H 31/00* (2006.01)

(52) U.S. Cl.
CPC ..... *H01H 33/6661* (2013.01); *H01H 31/003* (2013.01)

(58) Field of Classification Search
CPC ..... H01H 33/6661; H01H 33/666; H01H 2033/66246; H01H 2033/66253; H01H 31/003

(Continued)

(56) References Cited

U.S. PATENT DOCUMENTS 1,015,410 A * 1/1912 Einschenk ..... F24C 15/12 126/214 R
3,655,930 A 4/1972 Frey
(Continued)

FOREIGN PATENT DOCUMENTS

EP 1 139 367 A1 10/2001
EP 2 037 475 A1 3/2009
(Continued)

OTHER PUBLICATIONS

French Preliminary Search Report dated May 16, 2017 in French Application 16 58958, filed on Sep. 23, 2016 (with English Translation of Categories of cited documents & Written Opinion).

*Primary Examiner* — Edwin A. Leon
*Assistant Examiner* — William Bolton
(74) *Attorney, Agent, or Firm* — Oblon, McClelland, Maier & Neustadt, L.L.P.

(57) ABSTRACT

An actuation system of a vacuum bottle for an electrical connection device, the vacuum bottle including one movable electrode and one fixed electrode, the movable electrode being movable longitudinally between a closed position in which the two electrodes are in contact with each other and an open position in which the two electrodes are separated. The actuation system includes an adjusting nut linked to the movable electrode and capable of rotation for adjusting its position in relation to the movable electrode, a driving device acting on the adjusting nut for driving the movable electrode towards the open position, and a locking device for locking the position of the adjusting nut in relation to the movable electrode.

8 Claims, 2 Drawing Sheets

(58) Field of Classification Search
USPC ..... 218/140, 120, 124, 146, 153, 154, 118; 200/400
See application file for complete search history.

(56) References Cited

U.S. PATENT DOCUMENTS

| | | | | |
|---|---|---|---|---|
| 5,449,868 | A * | 9/1995 | Monson | H01H 33/666 218/118 |
| 6,410,875 | B2 * | 6/2002 | Allard | H01H 1/5822 218/118 |
| 6,649,854 | B1 * | 11/2003 | Bauer | H01H 33/666 218/120 |
| 7,098,418 | B1 * | 8/2006 | Yamada | H01H 1/0015 218/120 |
| 7,811,038 | B2 * | 10/2010 | Jimenez | F16B 39/32 411/328 |
| 8,242,399 | B2 * | 8/2012 | van Dijk | H01H 33/42 200/400 |
| 8,581,135 | B2 * | 11/2013 | Piccoz | H01H 33/126 218/140 |
| 2001/0025829 | A1 | 10/2001 | Marin-Pache et al. | |
| 2009/0071811 | A1 | 3/2009 | Van Dijk et al. | |

FOREIGN PATENT DOCUMENTS

| | | |
|---|---|---|
| JP | 11-7871 | 1/1999 |
| SU | 1332407 A1 | 8/1987 |

* cited by examiner

ACTUATION SYSTEM OF A VACUUM BOTTLE

TECHNICAL FIELD OF THE INVENTION

The present invention relates to an actuation system of a vacuum bottle (or vacuum bulb) for the purpose of opening an electrical circuit in a medium voltage or high voltage electrical connection device, i.e. a device operating at a voltage higher than 1000 V.

The invention also relates to an electrical connection device comprising such an actuation system for at least one of the phases of same. In the present document, the term electrical connection device equally includes multiple types of electrical devices such as a switch, a circuit breaker, a contactor, a fuse switch, a recloser, etc.

PRIOR ART

A medium voltage or high voltage electrical connection device of the type described in the document EP2182536 comprises a vacuum bottle which is placed not in the main circuit including the main switch of a phase of the device, but in a branch in parallel with this main switch. In normal operation, when the main switch is closed, no current passes in the vacuum bottle. This is only required during an opening operation of the main circuit, with the aid of an opening mechanism of the main switch that first makes it possible to switch the current gradually from the main circuit to the branch, which makes it possible to open the main switch while the current passes fully in the vacuum bottle. It is then opened in its turn by the opening mechanism. Thus the occurrence of an electrical switching arc is avoided at the main switch during the opening operation.

Thanks to this architecture, the vacuum bottle receives a current only during the opening phase of the main phase circuit, and not during normal operation. In addition, the bottle is not required during a closing operation of the main circuit and neither does it have to withstand a possible short-circuit current. It must just be capable of withstanding a transient recovery voltage (TRV) after the current is cut off in the main circuit.

As a result, the vacuum bottle may advantageously be simplified and designed with a much smaller size in relation to a conventional architecture in which the vacuum bottle is placed in the main circuit of the electrical connection device.

However, the opening mechanism which makes it possible to switch the current gradually from the main circuit to the branch then to open the vacuum bottle placed in the branch must be very precise and reproducible for ensuring on the one hand that, for each phase, the opening of the vacuum bottle is actually carried out only once the main switch is already sufficiently open to avoid the risk of any electrical arc on the main switch, and on the other hand that the vacuum bottles of the different phases of the device are actually opened simultaneously.

The documents U.S. Pat. No. 2,655,930 and EP1139367 describe electrical connection devices having a mechanism comprising an adjusting nut which is used to modify the contact pressure of a vacuum bottle.

The documents U.S. Pat. No. 8,471,186 and U.S. Pat. No. 8,466,835 describe relatively complex mechanical adjustment systems for the adjustment between the contacts of a switch of an electrical switchgear.

One of the purposes of the invention is to find a simple, reliable and economic system that makes it possible both to perform the opening movement of a vacuum bottle and to be able to easily and precisely adjust the instant of tripping this opening movement.

DISCLOSURE OF THE INVENTION

For this, the invention describes an actuation system of a vacuum bottle for an electrical connection device, the vacuum bottle including one movable electrode and one fixed electrode, the movable electrode being movable longitudinally between a closed position in which the two electrodes are in contact with each other and an open position in which the two electrodes are separated. The actuation system includes:

- an adjusting nut linked to the movable electrode and capable of rotation so as to adjust the position of the adjusting nut in relation to the movable electrode and thereby to vary the instant at which the movable electrode begins a movement towards the open position,
- a driving device acting on the adjusting nut for driving the movable electrode towards the open position,
- a locking device for locking the position of the adjusting nut in relation to the movable electrode.

According to one feature, the driving device comprises a hoop acting against a rim of the adjusting nut for driving the movable electrode towards the open position.

According to another feature, the locking device comprises a locking screw for preventing the rotation of the adjusting nut. Alternatively, the locking device comprises a locking collar detachably mounted on the driving device and comprising notches which engage with teeth of the adjusting nut. The detachable locking collar is snapped onto two lateral extensions of the driving device.

According to another feature, the actuation system includes a threaded collar and a sleeve which is fixed to the movable electrode and driven by the threaded collar, the threaded collar being provided with an external thread engaging with an internal thread of the adjusting nut for adjusting the position of the adjusting nut in relation to the movable electrode. The sleeve is fixed to the movable electrode by a transverse fixing screw which is also used to electrically connect the movable electrode to a connecting cable of the main circuit of the electrical connection device.

According to an alternative feature, the actuation system includes a threaded collar, a gudgeon screwed to the end of the movable electrode and a fixing screw for fixing the collar with the gudgeon, the threaded collar being provided with an external thread engaging with an internal thread of the adjusting nut for adjusting the position of the adjusting nut in relation to the movable electrode. It also comprises an anti-torsion device provided with longitudinal splines engaging with corresponding splines of the gudgeon.

The invention also describes an electrical connection device comprising a main phase switch and such an actuation system of a vacuum bottle, the vacuum bottle being placed in a branch off the main phase switch. According to another feature, the driving device of the vacuum bottle moves under the action of an opening mechanism of the main phase switch.

BRIEF DESCRIPTION OF THE FIGURES

Other features will appear in the detailed description that follows made with reference to the accompanying drawings in which:

With reference to FIGS. 1 and 2, an electrical connection device comprises a main phase switch and a vacuum bottle which is placed in a branch off the main switch. The vacuum bottle 1 is mounted in a support 5. In a known way, the vacuum bottle 1 comprises a movable conducting electrode 2 (also called a movable rod) and a fixed conducting electrode 3 (also called a fixed rod). The movable electrode 2 is movable longitudinally between a "closed" position in which the two electrodes 2, 3 are in contact with each other and an "open" position in which the two electrodes 2, 3 are separated. In all the figures of the present document, the vacuum bottle 1 is represented in the closed position.

Figure 1:
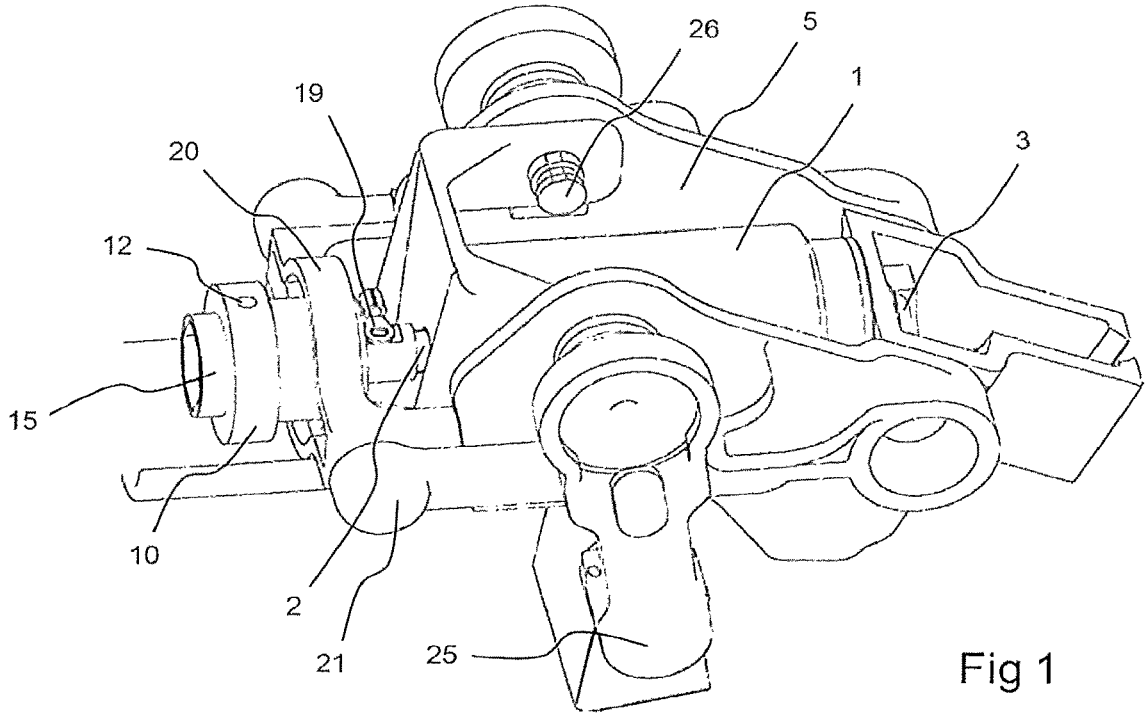
FIGS. 1 and 2 depict views of a first embodiment of the invention, in perspective and in partial section respectively.

The movable electrode 2 of the vacuum bottle is driven by an actuation system that makes it possible notably to perform an opening movement of the vacuum bottle 1, i.e. passing from the closed position to the open position. For performing the reverse movement of closure, i.e. passing from the open position to the closed position, the movable electrode 2 may, for example, be driven by a return spring not represented in the figures.

The actuation system according to the invention comprises a driving device including a paddle 25, rotatably movable about a transverse shaft 26, and a ring 20 which is rigidly connected to the paddle 25 via two lateral connecting rods 21. During an opening operation of a main phase switch of the electrical connection device, this driving device moves under the action of an opening mechanism of the main phase switch (not represented in the figures) which acts on the paddle 25. The various figures thus depict an arrow diagrammatically displaying the thrust exerted by the opening mechanism on the paddle 25 and on the connecting rods 21 during the opening movement of the vacuum bottle 1.

In the case of a multiphase (e.g. three-phase) electrical connection device therefore having a main switch for each of the phases, the device preferably comprises a vacuum bottle in a branch off each main switch and therefore an actuation system of the vacuum bottle for each phase. The opening mechanism acting on the actuation systems of such a device may, however, be common to all the main switches of the device.

The actuation system also comprises an adjusting nut 10 which is linked to the movable electrode 2 and which is capable of rotation for adjusting the position of same in relation to the movable electrode 2. During the opening movement, the ring 20 of the driving device abuts against a rim 11 of the adjusting nut 10 so as to be able to drive the movable electrode 2 towards the open position of the vacuum bottle 1.

Advantageously, the adjusting nut 10 therefore fulfils multiple functions which makes the solution simple and economic to implement. It is used to transmit the movement of the opening mechanism of the connection device towards the movable electrode 2 of the vacuum bottle 1. It is also used to adjust the precise instant at which the fixed 3 and movable 2 electrodes of the vacuum bottle will be separated by acting on the adjustment between the adjusting nut 10 and the movable electrode 2. Indeed, by slightly turning the adjusting nut 10 in one direction or another, the distance is varied between the ring 20 and the rim 11 of the adjusting nut 10, and therefore the instant is varied at which the movable electrode 2 will begin its opening movement.

Advantageously, the adjusting nut 10 is thus used to adjust the opening travel of the vacuum bottle 1 and does not modify the contact pressure.

According to the first embodiment in FIGS. 1 and 2, the link between the adjusting nut 10 and the movable electrode 2 is made in the following manner the actuation system comprises a threaded collar 15, provided with an external thread engaging with an internal thread of the adjusting nut 10 for adjusting the adjusting nut 10 in relation to the movable electrode 2, and comprises a sleeve 18 introduced inside the threaded collar 15 and fixed to the movable electrode.

The sleeve 18 is fixed to the movable electrode 2 by a transverse fixing screw 19 which passes through the sleeve 18 and the movable electrode 2. Advantageously, the fixing screw 19 is also used for fixing a conducting cable (not represented in the figures) that electrically connects the movable electrode 2 of the vacuum bottle 1 to the electrical connection device. In addition, it also makes it possible to clamp the threaded collar 15 between the rim of the sleeve 18 and the screw 19.

Figure 2:
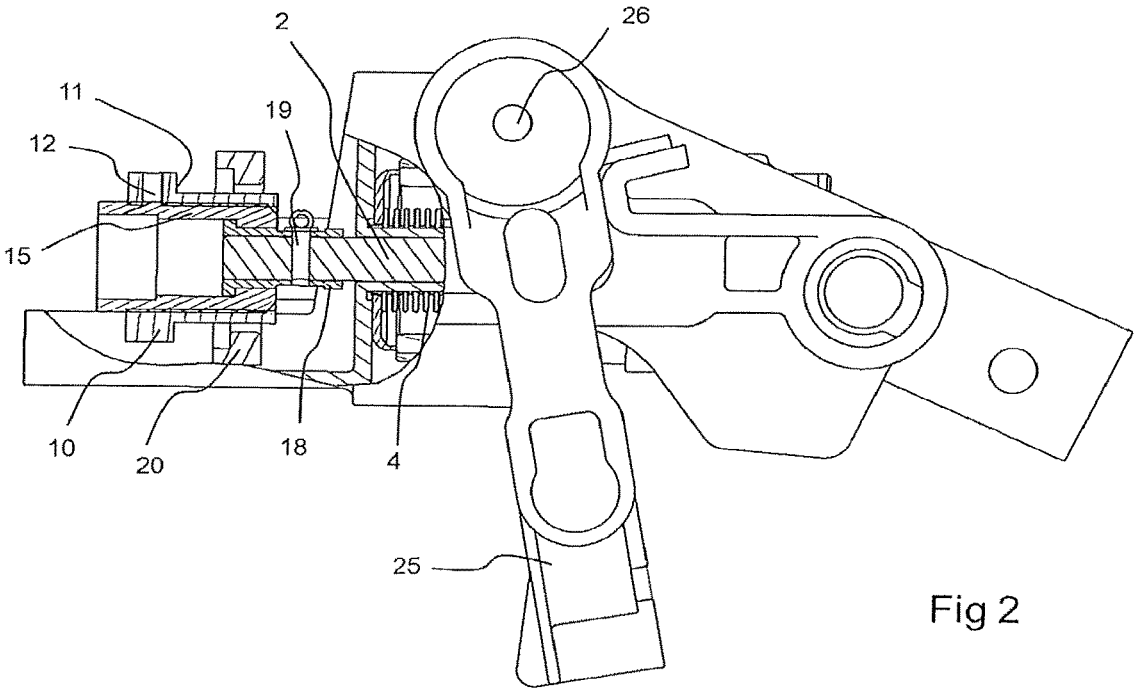

The threaded collar 15 is arranged for being able to drive the sleeve 18 during the opening movement, e.g. thanks to their respective rim as depicted in FIG. 2, but it is not fixed to the sleeve 18. In particular, the threaded collar 15 is advantageously freely rotational in relation to the sleeve 18, which avoids any risk of torsion of the movable electrode 2 and therefore of the bellows seal 4 of the vacuum bottle, during the rotation of the adjusting nut 10.

The actuation system further comprises a locking device that makes it possible to freeze the position of the adjusting nut 10 in relation to the movable electrode 2, once the adjustment is performed. The locking device includes a locking screw 12, e.g. a set screw which, once tightened, makes it possible to prevent the rotation of the adjustment nut 10 in relation to the threaded collar 15, and therefore to lock the relative position of same in relation to the movable electrode 2.

Figure 3:
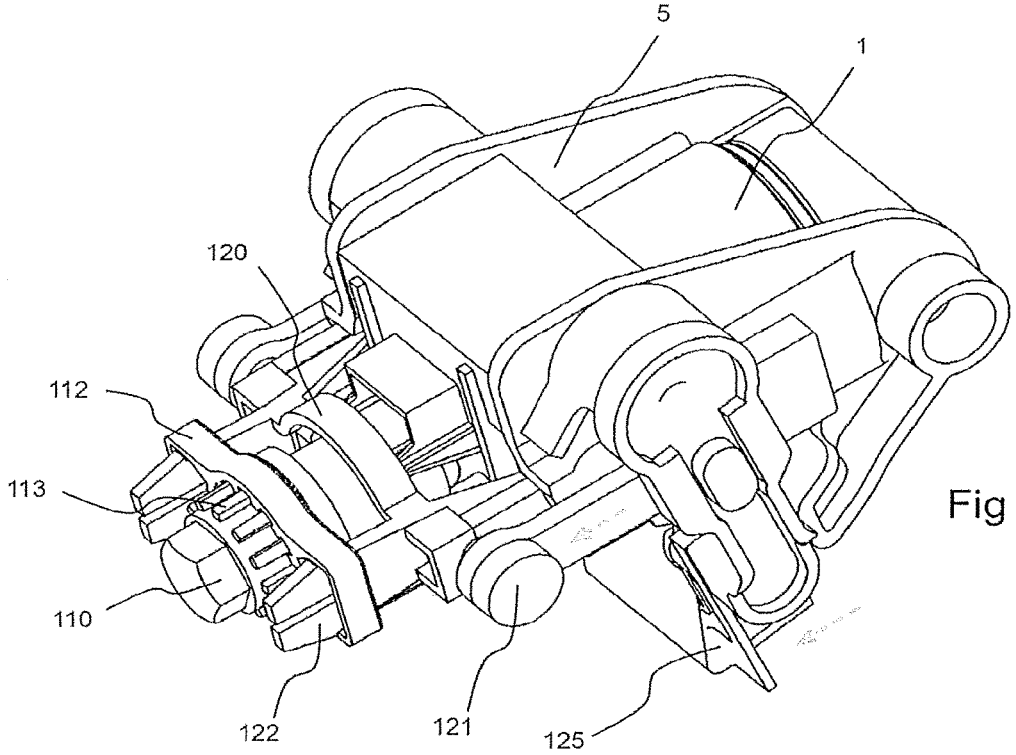
FIGS. 3 and 4 depict views of a second embodiment of the invention, in perspective and in partial section respectively.
Figure 4:
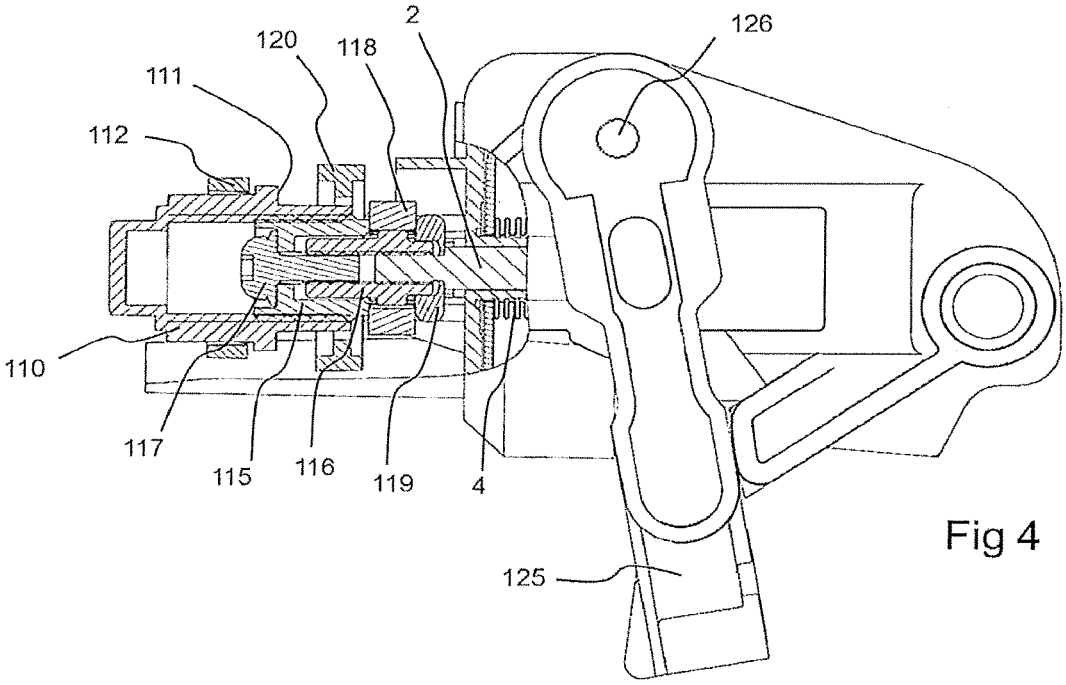

FIGS. 3 and 4 depict a second embodiment of the invention. In this embodiment, the electrical connection device comprises a vacuum bottle 1 identical to that previously described and mounted in a support 5.

As for FIGS. 1 and 2, the movable electrode 2 of the vacuum bottle is driven by an actuation system for performing an opening movement. For performing the reverse movement of closure and passing from the open position to the closed position, the movable electrode 2 may be driven in the same way, for example, by a return spring not represented in the figures.

As for FIGS. 1 and 2, the actuation system comprises a driving device including a paddle 125, rotatably movable about a transverse shaft 126, and a ring 120 which is actuated by the paddle 125 via two lateral connecting rods 121. During an opening operation of the main circuit of one phase of the electrical connection device, this driving device moves under the action of the opening mechanism of the main phase switch (not represented in the figures) which acts on the paddle 125.

The actuation system also comprises an adjusting nut 110 which is linked to the movable electrode 2 and which is capable of rotation for adjusting the position of same in relation to the movable electrode 2. During the opening movement, the ring 120 of the driving device abuts against a rim 111 of the adjusting nut 110 so as to be able to drive the movable electrode 2 towards the open position of the vacuum bottle 1.

This adjusting nut 110 is thus used to transmit the movement of the opening mechanism of the switching device towards the movable electrode 2 of the vacuum bottle 1 and to adjust the precise instant at which the fixed 3 and movable 2 electrodes of the vacuum bottle will be separated by acting on the adjustment between the adjusting nut 110 and the movable electrode 2. Indeed, by slightly turning the adjusting nut 110 in one direction or another, the distance is varied between the rim 111 of the adjusting nut 110 and the ring 120, and therefore the instant is varied at which the movable electrode 2 will begin its opening movement.

In the context of the second embodiment in FIGS. 3 and 4, the link between the adjusting nut 110 and the movable electrode 2 is made in the following manner the actuation system comprises a threaded collar 115 provided with an external thread engaging with an internal thread of the adjusting nut 110 for adjusting the adjusting nut 110 in relation to the movable electrode 2, and also comprises a gudgeon 116, an anti-torsion device 118, a washer 119 and a fixing screw 117.

The gudgeon 116 comprises an internal thread which both engages with an external thread on the end of the movable electrode 2 and engages with the fixing screw 117. Thus, when the screw 117 is introduced into the collar 115, it is pressed against a rim of the collar 115 and, once screwed to the gudgeon 116, maintains the assembly consisting of the collar 115, the gudgeon 116, the anti-torsion device 118, the washer 119 and the movable electrode 2. The washer 119 is used for fixing a conducting cable (not represented in the figures) making it possible to electrically connect the movable electrode 2 of the vacuum bottle 1 to the electrical connection device.

For avoiding any risk of torsion of the movable electrode 2 and therefore of the bellows seal 4 of the vacuum bottle 1 during the opening movement and especially during the adjustment of the nut 110, the anti-torsion device 118 is, for example, a fixed part which is clamped in the support 5 of the vacuum bottle 1 and which includes internal longitudinal splines engaging with corresponding external splines on the gudgeon 116, so that, during the movements of the movable electrode 2, the gudgeon 116 may slide longitudinally but without risk of rotation in relation to the support 5.

Finally, in the second embodiment, the actuation system further comprises a locking device that makes it possible to freeze the position of the adjusting nut 110 in relation to the movable electrode 2, once the adjustment is performed. The locking device comprises a locking collar 112 which is removable. This locking collar 112 is introduced into two lateral extensions 122 extending from each side of the ring 20. These extensions comprise, for example, clipping means which make it possible to easily snap on the locking ring 112 for holding it in a locking position once the adjustment has been made, and which also make it possible to be very easily removed when an operator wishes to adjust the position of the adjusting nut 110.

Once the locking collar 112 is snapped on, the adjusting nut 110 is locked by notches in the locking collar 112 which engage with teeth 113 of the adjusting nut 110 positioned around its outer periphery for preventing the rotation of the nut 110. The number of teeth/notches determines the fineness of the possible adjustment angle of the adjusting nut 110 in relation to the movable electrode 2.

For being able to turn the adjusting nut 110 more easily during adjustment, the latter optionally possesses at its end a shape which allows it to be manipulated with a key or a tool, such as a hexagonal shape in the example in FIG. 3.

The invention claimed is:

1. An actuation system of a vacuum bottle for an electrical connection device, the vacuum bottle including one movable electrode and one fixed electrode, the movable electrode being movable longitudinally between a closed position in which the two electrodes are in contact with each other and an open position in which the two electrodes are separated, the actuation system comprising:

an adjusting nut linked to the movable electrode and capable of rotation so as to adjust a position of the adjusting nut in relation to the movable electrode and thereby to vary an instant at which the movable electrode begins a movement towards the open position;

a driving device acting on the adjusting nut for driving the movable electrode towards the open position;

a locking device for locking the position of the adjusting nut in relation to the movable electrode; and a threaded collar and a sleeve, the sleeve being fixed to the movable electrode and driven by the threaded collar, the threaded collar being provided with an external thread engaging with an internal thread of the adjusting nut for adjusting the position of the adjusting nut in relation to the movable electrode.

2. The actuation system according to claim 1, wherein the driving device includes a hoop acting against a rim of the adjusting nut for driving the movable electrode towards the open position.

3. The actuation system according to claim 1, wherein the locking device includes a locking screw for preventing the rotation of the adjusting nut.

4. The actuation system according to claim 1, wherein the locking device includes a removable locking collar detachably mounted on the driving device, the removable locking collar including notches which engage with teeth of the adjusting nut.

5. The actuation system according to claim 4, wherein the removable locking collar is snapped onto two lateral extensions of the driving device.

6. The actuation system according to claim 1, wherein the sleeve is fixed to the movable electrode by a transverse fixing screw used to electrically connect the movable electrode to a connecting cable of a main circuit of the electrical connection device.

7. The actuation system according to claim 1, further comprising:

a gudgeon screwed to the end of the movable electrode and a fixing screw for fixing the threaded collar with the gudgeon.

8. The actuation system according to claim 7, further comprising:

an anti-torsion device provided with longitudinal splines engaging with corresponding splines of the gudgeon.

* * * * *